United States Patent [19]

Takanashi

[11] Patent Number: 4,497,406

Date of Patent: Feb. 5, 1985

[54] PACKAGE FOR STORAGE OF MEDICAL CONTAINER

[75] Inventor: Nobuyasu Takanashi, Fujinomiya, Japan

[73] Assignee: Terumo Corporation, Tokyo, Japan

[21] Appl. No.: 426,215

[22] Filed: Sep. 28, 1982

[30] Foreign Application Priority Data

May 6, 1982 [JP] Japan ..... 57-74503

[51] Int. Cl.[3] ..... B65D 81/20

[52] U.S. Cl. ..... 206/438; 156/69; 206/524.2; 206/524.6; 206/557; 229/3.5 R; 428/35; 428/475.8

[58] Field of Search ..... 156/69; 206/363, 438, 206/439, 440, 484, 484.1, 484.2, 524.1, 524.2, 524.6, 557, 621, 813, 828; 229/3.5 R, 43; 428/35, 354, 475.8, 515

[56] References Cited

U.S. PATENT DOCUMENTS

| | | | |
|---|---|---|---|
| 3,264,165 | 8/1966 | Stickel | 206/524.2 |
| 3,274,004 | 9/1966 | Curler et al. | 229/3.5 R |
| 3,570,748 | 3/1971 | Coyle et al. | 229/3.5 R |
| 3,595,465 | 7/1971 | Vaillancourt | 206/439 |
| 4,055,672 | 10/1977 | Hirsch et al. | 206/439 |
| 4,239,826 | 12/1980 | Knott et al. | 428/475.8 |
| 4,256,784 | 3/1981 | Gebhardt et al. | 428/515 |
| 4,355,721 | 10/1982 | Knott et al. | 428/35 |
| 4,373,636 | 2/1983 | Hoffman | 229/43 |

FOREIGN PATENT DOCUMENTS

| | | |
|---|---|---|
| 217968 | 6/1924 | United Kingdom . |
| 813415 | 5/1959 | United Kingdom . |
| 1091406 | 11/1967 | United Kingdom . |
| 1215369 | 12/1970 | United Kingdom . |
| 1248768 | 10/1971 | United Kingdom . |
| 1527212 | 10/1978 | United Kingdom . |
| 2003836 | 3/1979 | United Kingdom . |
| 2024781 | 1/1980 | United Kingdom . |

*Primary Examiner*—George E. Lowrance
*Assistant Examiner*—Jimmy G. Foster
*Attorney, Agent, or Firm*—Frishauf, Holtz, Goodman & Woodward

[57] ABSTRACT

A package for storing therein a medical container in conjunction with a deoxidizer covered on at least one side thereof with a gas-impervious sheet and on at least one other side thereof with a gas-pervious sheet, which package is characterized by comprising a tightly sealed container adapted to hold the aforementioned deoxidizer in such a manner that the gas-pervious sheet sides of the deoxidizer rests on at least one of the inner sides thereof and provided in the inner side thereof adjoining the gas-pervious sheet side of the aforementioned deoxidizer with at least one passage for gas communicating with the atmosphere enclosed with the package.

14 Claims, 5 Drawing Figures

PACKAGE FOR STORAGE OF MEDICAL CONTAINER

BACKGROUND OF THE INVENTION

1. Field of the Invention

This invention relates to a package for the storage of a plastic medical container. More particularly, this invention relates to a package for the storage of a plastic medical container such as a blood bag or a transfusion solution bag which contains therein a medicinal fluid.

2. Description of Prior Arts

Plastic medical containers such as blood bag and transfusion bag contain therein anticoagulants such as ACD solution and CPD solution which serve to prevent the blood from being coagulated during collection or transfusion of blood. The medical containers containing such chemical solution are stowed in tightly closed containers of synthetic resin designed exclusively for the purpose of storage. Since the medical containers are made of plastic materials and therefore are pervious to gases, there is a possibility that oxygen gas, for example, will penetrate through these containers and pass into the chemical solutions contained therein to cause oxidative degradation of the chemical solutions. The wetting components, particularly the moisture, present in the chemical solutions penetrate through the walls of the containers and add to the humidity within the packages. If aerobic microorganisms survive by some reason or other within the chemical solutions, there ensues an inevitable possibility that microorganisms, which collect on the surface of the containers between the time these containers are manufactured and the time they are put to use will gain in growth because of the heightened humidity.

It has been recently proposed to place a deoxidizer tightly closed containers to effect quick fall of the concentration of oxygen within the tightly closed containers and prevent the contents of the containers from oxidation. As a tightly closed container suited to the proposed prevention of its contents from oxidation, there has been proposed a bag-shaped container which is obtained by vacuum depositing aluminum on the opposed surfaces of two superposed polyester type resin sheets and heat sealing the corresponding peripheries of the two sheets through the medium of a hot melt type adhesive agent (Japanese Published Unexamined Patent No. SHO 53(1978)-113693). Since the bag-shaped container is deficient in a shape-retaining property, the inner volume of the container decreases and the walls of the bag sink as the oxygen therein is gradually absorbed by the deoxidizer. When the contents held in the container and the walls of the container adhere fast to the surfaces of the deoxidizer, the absorption of oxygen by the deoxidizer fails to proceed at the expected rate and the concentration of oxygen in the container fails to fall to the prescribed level (less than 0.1%/50 hrs), frequently with the result that microorganisms which by chance have found their way into the containers in the course of fabrication will enjoy growth in the presence of oxygen. Further, the bag-shaped container has an inferior shape-retaining property, it tends to inconvenience various handling works for storage. When such bag-shaped containers are piled up during storage or in transit, they collapse and bring about adverse effects upon their container contents. When the container is molded threedimensionally, since the conditions involved in the molding deform and crack the conventional barrier layers formed of aluminum, for example, to intercept gases and steam, the container is destitute of a gas barrier property.

As a deoxidizer, a powdered deoxidizer which is composed of a metal such as iron and a halogenated metal has been known. Such a deoxidizer is used as contained in a bag-like container previous to gases. As the deoxidizer absorbs oxygen, the metal used therein gathers rust. Particularly when the metal happens to be iron, it rusts in red. The red rust exudes through the walls of the bag-like container, comes into contact with the medical container and soils it. To eliminate this problem, a membrane impervious to gases is attached to one of the walls of the aforementioned bag-like container. This bag-like container is used with the membrane side thereof facing the medical container held in the package. When the gas-impervious membrane side of the bag-like container is directed toward the medical container, the gas-pervious wall side thereof comes into contact with the bottom surface of the package. Consequently, the overall area of the package in which the interior of the package is exposed to contact with the ambient gas is notably decreased. Because of the heavy decrease of contact area, it becomes no longer possible to lower the concentration of oxygen within a stated length of time to a prescribed level, namely to an oxygen concentration of not more than 0.1% by volume within 72 hours, the very conditions tolerated for the prevention of growth of aerobic microorganism. Thus, the interior of the package cannot be brought to a substantially oxygen-free condition. The package, therefore fails to keep the medical container held therein from growth of aerobic microorganism and other defiling causes.

It is, therefore, an object of this invention to provide a novel package for the storage of a medical container. Another object of this invention is to provide a package for the storage of a medical container holding therein a medicinal fluid, which package is capable of retaining its interior in a substantially oxygenfree condition and preventing it from growth of aerobic microorganism.

SUMMARY OF THE INVENTION

The objects described above are attained by a package for storing therein a medical container in conjunction with a deoxidizer covered on at least one side thereof with a gasimpervious sheet and on at least one other side thereof with a gas-pervious sheet, which package is characterized by comprising a tightly sealed container adapted to hold the aforementioned deoxidizer in such a manner that the gas-pervious sheet sides of the deoxidizer rests on at least one of the inner sides thereof and provided in the inner side thereof adjoining the gas-pervious sheet side of the aforementioned deoxidizer with at least one recess communicating with the atmosphere enclosed with the package.

This invention also embraces the package for storage which comprises a tray part provided round the opening thereof with a flange portion, a sheet-like lid member and a hotmelt adhesive layer interposed between the flange portion and the sheet-like lid member to serve as a medium for the flange portion and the lid member to be peel openably heat sealed. It further embraces the package wherein the tray part is formed of a laminated sheet comprising a polyolefin layer, a layer capable of barriering passage of gases and steam and a polyolefin layer, the lid member is formed of a laminated sheet comprising a polyamide layer, a layer capable of barriering passage of gases and steam and a layer possessed of thermal resistance enough to withstand the conditions of heat sealing, and the hotmelt adhesive layer comprises a plurality of materials of dissimilar melting point and including at least one material identical with the polyolefin in the aforementioned tray part. It embraces the package wherein the polyolefin layer in the tray part is made of polypropylene and the hotmelt adhesive layer is made of a blend of polyethylene with polypropylene. It embraces the package wherein the weight ratio of polyethylene to polypropylene in the hotmelt adhesive layer is in the range of 20:80 to 50:50. This invention further embraces the package wherein the layer capable possessed of thermal resistance enough to withstand the conditions of heat sealing is formed of polyester, polyamide or polypropylene. It also embraces the package wherein the recess is formed in the bottom portion of the package. It embraces the package wherein the layer of the lid member capable of barriering passage of gases and steam is formed of polyvinylidene chloride or ethylene-vinyl alcohol copolymer. It also embraces the package wherein the layer of the tray part capable of barriering passage of gases and steam is formed of ethylene-vinyl alcohol copolymer. It further embraces the package wherein at least the tray part thereof possesses transparency. This invention also embraces the package wherein the therapeutic container held in the package contains therein a medicinal fluid.

PREFERRED EMBODIMENT OF THE INVENTION

Figure 1:
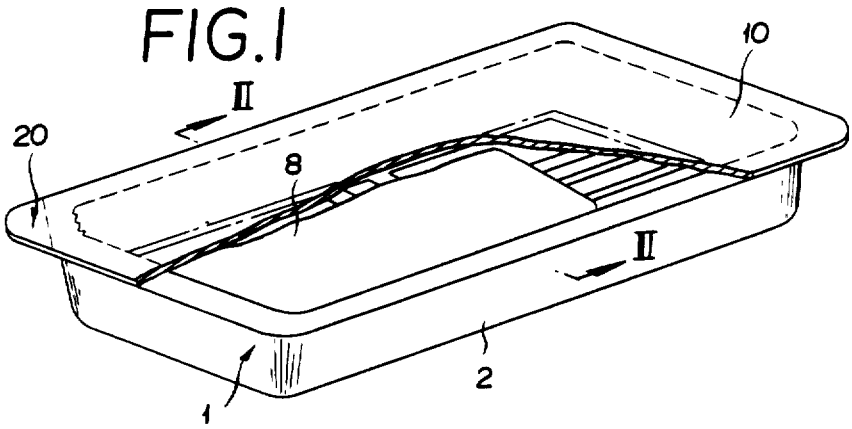
FIG. 1 is a perspective view illustrating one typical package of this invention for the storage of a medical container.
Figure 2:
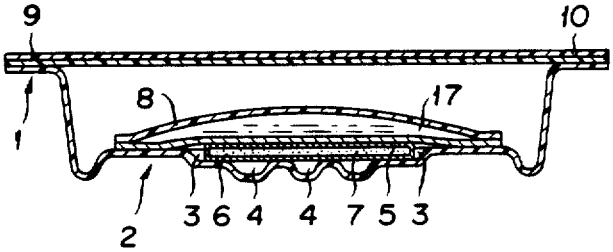
FIG. 2 is a cross section taken along the line II—II in the diagram of FIG. 1.
Figure 3:
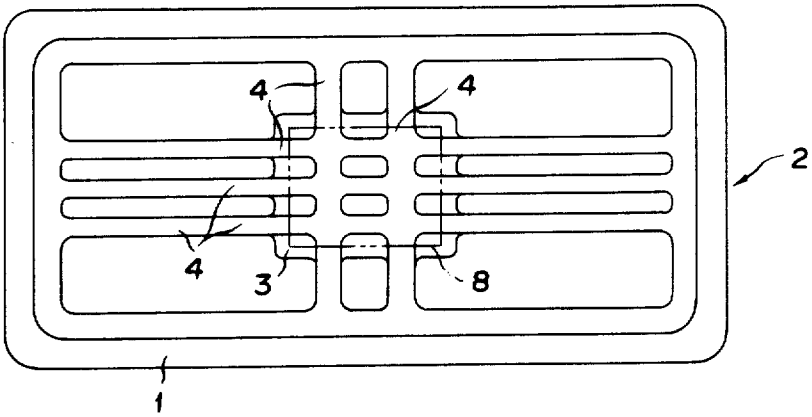
FIG. 3 is a plan view illustrating the condition of the package before the lid member is not in position thereon.

Now, one preferred embodiment of this invention will be described below with reference to the accompanying drawing. The package for the storage of a medical container according to this invention causes a tray part 2 provided round the opening thereof with a flange portion 1 to form a recessed portion 3 for receiving a deoxidizer 7 in at least one side thereof, for example, the bottom side, and further to form at least one groove 4 in the bottom portion of the recess portion as illustrated in FIGS. 1–3. The term "groove" used in the specification may be a shape capable of forming a passage for gas and the shape is not limited. Within this deoxidizer receiving portion 3, the deoxidizer 7 covered on at least one side thereof with a gas-impervious sheet 5 such as aluminum foil, synthetic resin film, paper or cloth impregnated or coated with was or synthetic resin and on at least one other side thereof, generally the side opposite the aforementioned side, with a gas-pervious sheet 6 such as paper or cloth is received in such a manner that the gas-pervious sheet 6 is positioned on the groove 4 side. The aforementioned groove 4 is formed so as to reach the outside of the deoxidizer receiving portion 3 and form a free passage for gases. After the deoxidizer 7 and the medical container 8 have been set in position within the tray part 2, the lid member 10 is heat sealed through the medium of the hotmelt adhesive layer 9 to the tray part 2 peel openably.

Figure 4:
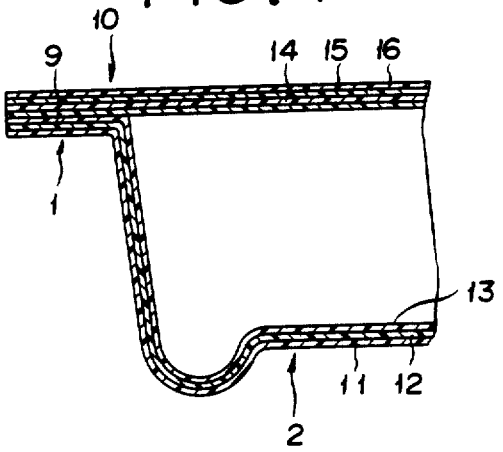
FIG. 4 is an enlarged cross section of part of the diagram of FIG. 2.

In the package of the present invention for the storage of the medical container, any of materials which are capable of barriering passage of gases and steam and are highly heat sealable can be used for the tray part 2 and the lid member 10. Examples are shown below. They are particularly excellent in shape-retaining property, ability to barrier passage of gases and steam and heat sealability and are transparent. As illustrated in FIG. 4, the tray part 2 is produced by molding in the shape of a tray a laminated sheet comprising a polyolefin layer (outer layer) 11, a layer capable of barriering passage of gases and steam (intermediate layer) 12 and a polyolefin layer (inner layer) 13. The lid member 10 is formed by laminating a polyamide layer (inner layer) 14, a layer capable of barriering passage of gases and steam (intermediate layer) 15 and a layer possessed of thermal resistance enough to withstand the conditions of heat sealing (outer layer) 16. The hotmelt adhesive layer 9 is formed of a blend of polyethylene with polypropylene.

Examples of the polyolefin which forms the outer layer 11 and the inner layer 13 of the tray part 2 are polyethylene and polypropylene. Polypropylene is preferred because of its excellence in shape-retaining property and thermal resistance over polyethylene. To be used advantageously herein, the polyethylene is required to have a molecular weight of 3,000 to 200,000, preferably 50,000 to 100,000, and the polypropylene to have a molecular weight of 5,000 to 1,000,000, preferably 100,000 to 500,000. The thickness of each of the polyolefin layers is 500 to 600 μm. The intermediate layer 12 of the tray part 2 which is capable of barriering passage of gases and steam is desired to be formed of ethylene-vinyl alcohol copolymer. The thickness of this layer is about 50 μm. The vinyl alcohol content of the copolymer is desired to be 20 to 80 mol%, preferably 40 to 70 mol%. The molecular weight of the copolymer is desired to be 5,000 to 100,000, preferably 10,000 to 50,000.

The hotmelt adhesive layer constituting the inner layer 14 of the lid member 10 is desired to be formed of a blend of polyethylene with polypropylene. The weight ratio of the polyethylene to the polypropylene in the blend, when the outer layer 11 of the tray part 2 is made of polypropylene, is desired to fall in the range of 20:80 to 50:50 from the standpoint of both heat sealability and peel openability of the ray part. The thickness of the inner layer 14 is 30 to 60 μm, preferably 40 to 50 μm. This layer of the blend is superposed by a layer of polyamide, such as, for example, a layer of nylon 6 or nylon-6,6. This nylon layer permits the lid member to retain its strength. The intermediate layer 15 which is capable of barriering passage of gases and steam is desired to be formed of polyvinylidene chloride or ethylene-vinyl alcohol copolymer. Generally, polyvinylidene chloride is used as superposed on a polyolefin film, particularly a biaxially drawn polypropylene film. Generally, the molecular weight of the polyolefin is 5,000 to 1,000,000 preferably 100,000 to 500,000. The thickness of the polyolefin film is 20 to 40 μm. The molecular weight of the aforementioned polyvinylidene chloride is 8,000 to 20,000, preferably 10,000 to 15,000, and the thickness of the polyvinylidene chloride film is 5 to 10 μm. This film exhibits an outstanding ability to barrier passage of gases and steam. A still better barrier property is obtained by using a plurality of such layers capable of barriering passage of gases and steam in a superposed form. To ensure safe storage of a plastic medical container holding a medicinal fluid therein, the intermediate layer 15 is desired to have not more than 1 g/m²,24 hr (40° C., 90% RH), preferably 0.1–0.2 g/m²,24 hr (40° C., 90% RH), of perviousness to humidity. To ensure prevention of growth of aerobic microorganisms, the gas barrier property of the intermediate layer 15 is desired to be not more than 0.1%/72 hr, preferably not more than 0.1%/50 hr of oxygen concentration within the package. Examples of the resin of the outer layer 16 which is possessed of thermal resistance enough to withstand the conditions of heat sealing include polyesters such as polyethylene terephthalate and polybutylene terephthalate, polyamides such as nylon 6 and nylon 6,6 and polypropylene. Among other polymers mentioned above, polyethylene terephthalate proves to be particularly desirable. The thickness of the outer layer 16 is 10 to 30 μm, preferably 12 to 25 μm.

The weight ratio of the polyethylene to the polypropylene in the hotmelt adhesive layer is from 20:80 to 50:50 where the inner layer 13 of the tray part 2 is formed of polypropylene and from 80:20 to 50:50 where the inner layer 13 is formed of polyethylene. This is because the seal is peel opened with great difficulty when the proportion in the blend of the material identical with the polyolefin forming the inner layer of the tray part 2 is too high and the adhesiveness of the flange portion and the lid member is insufficient when the proportion is too low.

The medical container to be stored in the package produced by the present invention is a container which holds a medicinal fluid therein. Examples of the medical container for which the package of this invention is advantageously usable include blood bags, transfusion bags, etc. containing therein anti-coagulants, fluids for transfusion, and other medicinal fluids such as, for example ACD-A solution (containing 2.20 g of sodium citrate, 0.80 g of citric acid and 2.20 g of grape sugar in 100 ml of aqueous solution, for example) and CPD solution (containing 0.327 g of citric acid, 2.63 g of sodium citrate, 0.251 g of disodium citrate and 2.32 g of dextrose in 100 ml of aqueous solution, for example) and these bags having their accessories such as tubes, connectors and syringes integrally molded therewith or connected thereto.

The package deoxidizer 7 in conjunction with the medical container 8 holding therein a medicinal fluid 17 as described above. The deoxidizer comes in numerous forms. A deoxidizer which comprises at least one compound selected from the group consisting of iron carbide, iron carbonyl, ferrous oxide, ferrous hydroxide and iron silicate and a halogenated metal (containing water when necessary) (Japanese Published Unexamined Patent NO. SHO 54(1979)-37088) and a deoxidizer which is obtained by coating a powdered metal with a halogenated metal (Japanese Published Unexamined Patent No. SHO 54(1979)-35189) are examples.

Figure 5:
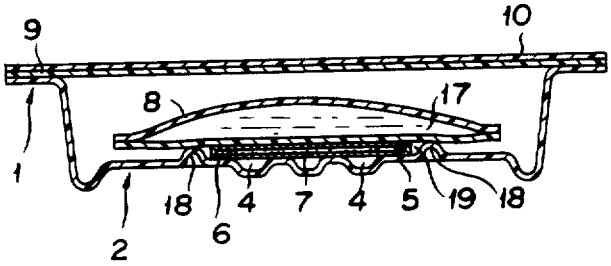
FIG. 5 is a cross section illustrating another typical package of this invention similarly to FIG. 2.

FIG. 5 illustrates another typical package of the present invention. This package forms on the bottom side of the tray part 2 a deoxidizer receiving portion 19 by projecting raised strips 18 from the bottom side instead of forming the portion by inserting a depression in the bottom side. In FIG. 5, the same numeric symbols as those of FIGS. 1–4 denote like members. The aforementioned deoxidizer receiving portion may be formed at one or more positions on the lateral sides of the tray part 2 or may not be formed at all. In the diagrams of FIGS. 1–5, the component layers of the package are illustrated in exaggerated thicknesses.

Storage of a medical container 8 in the package constructed as described above is accomplished by first placing the deoxidizer 7 in the tray part 2 in such a manner that the gas-pervious sheet 6 side thereof falls on the grooves 4 side, setting the medical container 8 preferably containing therein a medicinal fluid in the tray part 2, then applying the lid member 10 through the medium of the hotmelt adhesive layer 9 to the flange portion 1 of the tray part 2, and tightly heat sealing the lid member 10 and the flange portion 1 by high frequency or some other heating means. In this case, at least one small segment of the corner 20 of the flange portion 1 may be partially left intact by the heat sealing so that it will facilitate the peeling of the seal when the medical container is taken out and put to use. The aforementioned hotmelt adhesive layer 9 is generally used as superposed fast under application of heat and pressure on the flange 1 of the tray part 2 or on the periphery of the inner layer 14 of the lid member 10. Optionally, the adhesive layer 9 may be superposed on the lid member and extended outwardly and bent downwardly in a semicircular direction enough to seal the lid as wholly wrapped round the entire surface of the flange portion. Otherwise, the adhesive layer may be superposed on the entire surface of the lid member. Of course, the aforementioned deoxidizer may be placed in the tray part 2 at the same time that the medical container 8 is placed in the tray part 2 or before the medical container 8 is placed in the tray part 2.

EXAMPLES 1–7

As illustrated in FIGS. 1–4, in a tray part 2 formed of a laminated sheet comprising an outer layer 11 of polypropylene (having a molecular weight of 100,000 to 500,000) 500 μm in thickness, an intermediate layer 12 of ethylenevinyl alcohol copolymer (having a molecular weight of 10,000 to 50,000) 50 μm in thickness, and an inner layer 13 of polypropylene (having a molecular weight of 100,000 to 500,000) 500 μm in thickness, a pack of deoxidizer 7 held in a bag-like container having one wall thereof made of a gas-impervious sheet 5 obtained by vacuum depositing aluminum on a film of polyester (having a molecular weight of 100,000 to 500,000) and the other wall thereof made of a gas-pervious sheet 6 of paper was set in position in such a manner that the gas-pervious sheet 6 side thereof falls on the grooves 4 side. Further a blood bag 8 made of polyvinyl chloride and containing therein an anticoagulant was set in position in the tray part 2. Then, a lid member 10 obtained by laminating an inner nylon layer 15 μm in thickness, an intermediate layer 15 composed of two layers each of a film of biaxially drawn polypropylene (having a molecular weight of 100,000 to 500,000) 20 μm in thickness superposed by a layer of polyvinylidene chloride (having a molecular weight of 10,000 to 15,000) 10 μm in thickness, and an outer layer 16 of polyethylene terephthalate (having a molecular weight of 100,000 to 500,000) was heat sealed by high frequency to the flange portion 1 of the tray part 2 through the medium of a hotmelt adhesive layer 9 of a blend consisting of polyethylene (having a molecular weight of 50,000 to 100,000) and polypropylene (having a molecular weight of 100,000 to 500,000) in a weight ratio of 70:30 and superposed in advance on the nylon-6 (having a molecular weight of 20,000 to 50,000) layer of the flange portion 1 of the tray part 2. The packages thus produced were tested for concentration of oxygen contained therein by the use of a zirconia type analyzer (made by Toray Ltd). The results were as shown in Table 1. When the procedure described above was repeated by using ethylene-vinyl alcohol copolymer as the material for the layer of the lid member capable of berriering passage of gases and steam, there were obtained similar results.

COMPARATIVE EXPERIMENTS 1-5

The procedure of Example 1 was repeated, except that the tray part, though made of the same materials, had no grooves formed in the bottom side thereof and the bag-like container of the deoxidizer was set in position so that the gas-pervious sheet side thereof fell on the bottom side. The packages thus obtained were tested similarly to Example 1. The results were as shown in Table 1.

TABLE 1

| Example No. | Oxygen concentration (% by volume) After 24 hrs. | After 33 hrs. | After 48 hrs. | After 53 hrs. | After 57 hrs. |
|---|---|---|---|---|---|
| 1 | 11.0 | 6.4 | 0.163 | — | — |
| 2 | — | 7.0 | 0.310 | 0.093 | — |
| 3 | — | — | 0.067 | 0.048 | — |
| 4 | — | — | 0.055 | — | — |
| 5 | — | — | 0.080 | — | — |
| 6 | — | — | 0.187 | 0.070 | — |
| 7 | — | — | 0.076 | 0.054 | — |
| Comparative Experiment | | | | | |
| 1 | 15.2 | 12.5 | 7.6 | — | — |
| 2 | — | 13.7 | 9.9 | 8.7 | — |
| 3 | — | 10.9 | 5.4 | 3.68 | 2.06 |
| 4 | — | — | 6.3 | 4.86 | 3.37 |
| 5 | — | — | — | 4.17 | 2.67 |

The package for the storage of a medical container according to the present invention, as described above, is a package for storing therein a medical container in conjunction with a deoxidizer covered on at least one side thereof with a gas-impervious sheet and on at least one other side thereof with a gas-pervious sheet, which package is characterized by comprising a tightly sealed container adapted to hold the aforementioned deoxidizer in such a manner that the gas-pervious sheet sides of the deoxidizer rests on at least one of the inner sides thereof and preovided in the inner side thereof adjoining the gas-pervious sheet side of the aforementioned deoxidizer with at least one recess communicating with the atmosphere enclosed with the package. Since the surface of the aforementioned deoxidizer which comes into contact with the medical container stored in the package is impervious to gases, there is no possibility that the red rust produced by the deoxidizer upon absorption of oxygen will not adhere to the medical container. On the gas-pervious side of the deoxidizer, since at least one groove communicating with the atmosphere enclosed with the package is formed in the package, the groove constitutes itself a path through which the oxygen in the package is delivered to the deoxidizer and absorbed thereby. Consequently, the interior of the package can be brought to a substantially oxygen-free condition within a very short length of time. Owing to this quick deoxidization, even when the medical container stored within the package happens to be formed of a material such as polyvinyl chloride which is highly pervious to steam, the medicinal fluid held in the medical container is not subjected to oxidative degradation. Even if some aerobic microorganisms have by chance found their way into the container in the course of fabrication, they are not allowed to grow. Thus, the package can keep the medical container in a substantially sterilized state for a long time.

When the package, namely, the tightly sealed container, is composed of the specific laminated materials as described above, the tray enjoys high shape-retaining property and transparency because of the inner and outer polyolefin layers and the layer formed of ethylene-vinyl alcohol copolymer or some other similar material capable of barriering passage of gases and steam possesses an ability to barrier passage of steam and oxygen (gas) and transparency. Since the lid member is composed as described above, the layer of polyamide such as nylon provides peel openability and ample strength. Because of the use of the layer of polyvinylidene chloride and the layer of ethylene-vinyl acetate copolymer which are capable of barriering passage of gases and steam, the lid member acquires a high ability to barrier passage of gases and steam. Since the layer of resin possessed of thermal resistance enough to withstand the conditions of heat sealing is formed of polyester, polyamide, or polypropylene, the lid member enjoys ample shape-retaining property when it is exposed to the conditions of heat sealing. Since all the layers are transparent, the condition of the contents inside the package can be inspected clearly through the lid member. When the polyolefin layer in the tray part is formed of polypropylene and the hotmelt adhesive layer is formed of a bland of polyethylene with polypropylene, with the weight ratio of the polyethylene to the polypropylene selected in the range of 20:80 to 50:50, the package as a whole enjoys ample adhesive strength and high peel openability. Since the deoxidizer can be stowed in position on the bottom side of the package by forming grooves in the bottom side of the package, the production of packages of this invention can be mechanized. By forming at least the tray part of the package with transparent materials, the condition of the stage of the contents held inside the package can be inspected without opening the package.

When the package of this invention is adopted for the storage of a medical container such as a blood bag or transfusion bag holding therein an anticoagulant or some other medicinal fluid, it offers the advantage that possible growth of aerobic microorganisms under the wet conditions adcribable to the aforementioned medicinal fluid can be precluded because the interior of the package is brought to a substantially oxygen-free state within a very short length of time after the medical container is placed in the package.

What is claimed is:

1. A package for storing a medical container which contains a medical fluid, the package comprising:

a tightly sealed substantially gas-impervious vessel having a recess formed on the bottom of said vessel, said recess opening to the inside of said vessel; said vessel having a gas barrier property sufficient to limit the oxygen concentration in the package to no more than 0.1% by volume when said tray has been heat sealed for 72 hours;

a deoxidizer in said recess;

a gas-pervious sheet covering one side of said deoxidizer and being between said deoxidizer and said bottom of said vessel;

a gas-impervious sheet on at least one other side of said deoxidizer and facing upward and away from the bottom of said vessel; said medical container being in said vessel and above and in contact with said gas-impervious sheet;

at least one passage provided on the bottom inner side of said vessel and adjoining said gas-pervious sheet side of said deoxidizer for communicating said gas-pervious sheet side of said deoxidizer with the atmosphere enclosed within said tightly sealed vessel of the package whereby said medical container is in gas communication with said deoxidizer; and wherein said at least one passage comprises grooves formed in a surface of said bottom of said vessel, and said grooves extending from under the gas-pervious sheet covering said one side of said deoxidizer to remote from said gas-pervious sheet covering said one side of said deoxidizer.

2. The package of claim 1, wherein said vessel comprises:

a tray part having an upper opening, said recess being formed on the bottom of said tray part, and a flange portion provided around said opening;

a lid member in the shape of a sheet; and a hotmelt adhesive layer adapted to be inserted between said flange portion and said lid member, said flange portion and said lid member being peel openably heat sealed to each other via said hotmelt adhesive layer.

3. The package of claim 2, wherein:

said tray part comprises a laminated structure including a first polyolefin layer, an intermediate layer capable of barriering passage of gases and steam, and a second polyolefin layer, laminated on one another;

said lid member is a laminated sheet member comprising a polyamide layer, a layer capable of barriering passage of gases and steam, and a layer having sufficient thermal resistance to withstand heat sealing, laminated on one another; and said hotmelt layer comprises a plurality of materials of dissimilar melting points and including at least one material identical with the polyolefin used in said tray part.

4. The package of claim 3, wherein at least one of said polyolefin layers of said tray part is formed of polypropylene and said hotmelt adhesive layer is formed of a blend of polyethylene with polypropylene.

5. The package of claim 4, wherein the weight ratio of polyethylene to polypropylene in the hotmelt adhesive layer is in the range of 20:80 to 50:50.

6. The package of claim 3, wherein said lid member layer having sufficient thermal resistance to withstand the conditions of heat sealing is one member selected from the group consisting of polyester, polyamide and polypropylene.

7. The package of claim 3, wherein said layer of said lid member which is capable of barriering passage of gases and steam is formed of polyvinylidene chloride or ethylene-vinyl alcohol copolymer.

8. The package of claim 3, wherein said layer of said tray part capable of barriering passage of gases and steam is formed of ethylene-vinyl alcohol copolymer.

9. The package of claim 2, wherein at least said tray part possesses transparency.

10. The package of claim 3, wherein the gas barriering property of said intermediate layer is sufficient to limit the oxygen concentration in the package to no more than 0.1% by volume when said tray has been heat sealed for 72 hours.

11. The package of claim 10, wherein the gas barriering property of said intermediate layer is sufficient to limit the oxygen concentration in the package to no more than 0.1% by volume when said tray has been heat sealed for 50 hours.

12. The package of claim 3 wherein said intermediate layer is pervious to humidity in an amount of no more than 1 $g/m^2$ per 24 hours measured at a temperature or 40° C. and a relative humidity of 90%.

13. The package of claim 12, wherein said intermediate layer is pervious to humidity in an amount of no more than between 0.1–0.2 $g/m^2$ per 24 hours measured at a temperature of 40° C. and a relative humidity of 90%.

14. The package of claim 1, wherein said gas-impervious sheet is aluminum foil.

* * * * *